US012409526B1

(12) United States Patent
Cai

(10) Patent No.: US 12,409,526 B1
(45) Date of Patent: Sep. 9, 2025

(54) ELECTRIC KNIFE SHARPENER

(71) Applicant: Hangzhou Weikai e-commerce Co., Ltd., Hangzhou (CN)

(72) Inventor: Shuchun Cai, Wenzhou (CN)

(73) Assignee: Hangzhou Weikai e-commerce Co., Ltd., Hangzhou (CN)

( * ) Notice: Subject to any disclaimer, the term of this patent is extended or adjusted under 35 U.S.C. 154(b) by 0 days.

(21) Appl. No.: 19/026,774

(22) Filed: Jan. 17, 2025

(30) Foreign Application Priority Data

Dec. 30, 2024 (CN) ..... 202423272020.2

(51) Int. Cl.
*B24B 3/54* (2006.01)

(52) U.S. Cl.
CPC ..... *B24B 3/54* (2013.01)

(58) Field of Classification Search
CPC .... B24B 3/54; B24B 3/36; B24B 3/52; B24D 15/08; B24D 15/081; B24D 15/082; B24D 15/06; B24D 15/065
USPC ..... 451/194
See application file for complete search history.

(56) References Cited

U.S. PATENT DOCUMENTS 461,663 A * 10/1891 Brown ..... B24B 3/54 451/194
2,482,633 A * 9/1949 Nichols ..... B24B 3/54 451/194
2,617,235 A * 11/1952 Lindahl ..... B24B 3/543 76/87
2,853,053 A * 9/1958 Hamilton ..... B43L 23/04 144/28.72
3,758,993 A * 9/1973 Kirtz ..... B24B 3/54 451/194
3,811,226 A * 5/1974 Gangelhoff ..... B24B 3/54 451/194
6,071,181 A * 6/2000 Wightman ..... B24D 15/081 451/65
6,802,763 B1 * 10/2004 Leung ..... B24B 49/16 76/82
8,727,836 B2 * 5/2014 Smith ..... B24B 3/54 451/194

* cited by examiner

*Primary Examiner* — Joel D Crandall
(74) *Attorney, Agent, or Firm* — Jose Cherson Weissbrot

(57) ABSTRACT

The disclosure relates to an electric knife sharpener, including: a first grinding structure, the first grinding structure including a plurality of first grinding wheels which are parallel to each other and configured to sharpen a knife, and adjacent first grinding wheels being arranged spaced apart from each other; a second grinding structure, the second grinding structure including a plurality of second grinding wheels which are parallel to each other and configured to sharpen a knife, adjacent second grinding wheels being arranged spaced apart from each other, a grinding space for grinding a knife being formed between the first grinding structure and the second grinding structure, and the first grinding wheels and the second grinding wheels being arranged in a staggered manner; and an adjustment structure, the adjustment structure being capable of driving the second grinding structure to move.

9 Claims, 5 Drawing Sheets

ELECTRIC KNIFE SHARPENER

TECHNICAL FIELD

The disclosure relates to the field of knife sharpeners, and in particular to an electric knife sharpener.

BACKGROUND ART

In daily life, people often use various types of knives, and when the knives have been used for a long time, they are not conducive to use.

SUMMARY

The disclosure is implemented by means of the following technical solutions.

An electric knife sharpener includes: a first grinding structure, the first grinding structure including a plurality of first grinding wheels which are parallel to each other and configured to sharpen a knife, and adjacent first grinding wheels being arranged spaced apart from each other; a second grinding structure, the second grinding structure including a plurality of second grinding wheels which are parallel to each other and configured to sharpen a knife, adjacent second grinding wheels being arranged spaced apart from each other, a grinding space for grinding a knife being formed between the first grinding structure and the second grinding structure, a spacing between the adjacent first grinding wheels being greater than a thickness of each of the second grinding wheels, a spacing between the adjacent second grinding wheels being greater than a thickness of each of the first grinding wheels, and the first grinding wheels and the second grinding wheels being arranged in a staggered manner; and an adjustment structure, the adjustment structure being capable of driving the second grinding structure to move to adjust a depth by which each of the second grinding wheels is inserted into a corresponding spacing between the two adjacent first grinding wheels, so as to adjust a grinding included angle of the grinding space to allow the grinding space to be adapted to different knives.

List of reference signs: 1. First grinding structure; 2. First grinding wheel; 3. Second grinding structure; 4. Second grinding wheel; 5. Grinding space; 6. Spacing between adjacent first grinding wheels; 7. Spacing between adjacent second grinding wheels; 8. Adjustment structure; 9. Housing; 10. Sliding slot structure; 11. First portion; 12. Second portion; 13. First inclined surface; 14. Second inclined surface; 15. Sliding block; 16. Shift member; 17. First engagement portion; 18. Second engagement portion; 19. Driving device; 20. Electric motor; 21. Spindle; 22. First gear; 23. Second gear; 24. First rotating shaft; 25. Third gear; 26. Second rotating shaft; 27. Fourth gear; 28. Spring; 29. Elastic sheet structure; 30. Bump; 31. Recess; 32. Iron filings removal structure; 33. Magnet; 34. Footpad; 35. Suction cup structure.

DETAILED DESCRIPTION OF EMBODIMENTS

Specific embodiments of the disclosure will be described in detail in this section. Embodiments of the disclosure are illustrated in the accompanying drawings. The accompanying drawings serve to supplement the text description of the specification with figures, providing a visual understanding of each technical feature and the overall technical solution of the disclosure, but cannot be construed as a limitation to the scope of protection of the disclosure.

In the description of the disclosure, it should be understood that orientation or position relationships indicated by terms "upper", "lower", "front", "rear", "left", "right", etc. are orientation or position relationships as shown in the accompanying drawings, and these terms are just used to facilitate description of the disclosure and simplify the description, rather than indicating or implying that the mentioned device or element must have a specific orientation and must be constructed and operated in a specific orientation, and thus cannot be construed as a limitation to the disclosure.

In the description of the disclosure, "several" means one or more, "a plurality of" means two or more, "greater than", "less than", "over", etc. are construed as excluding the number, and "above", "below", "within", etc. are construed as including the number. The terms "first" and "second" in the description are merely intended to distinguish technical features, and cannot be construed as indicating or implying relative importance or implicitly indicating the number of the indicated technical features or implicitly indicating a sequence relationship of the indicated technical features.

In the description of the disclosure, unless otherwise explicitly defined, the words such as "arrange", "mount" and "connect" should be understood in a broad sense, and those skilled in the art can reasonably determine the specific meanings of the above words in the disclosure with reference to the specific contents of the technical solutions.

Figure 1:
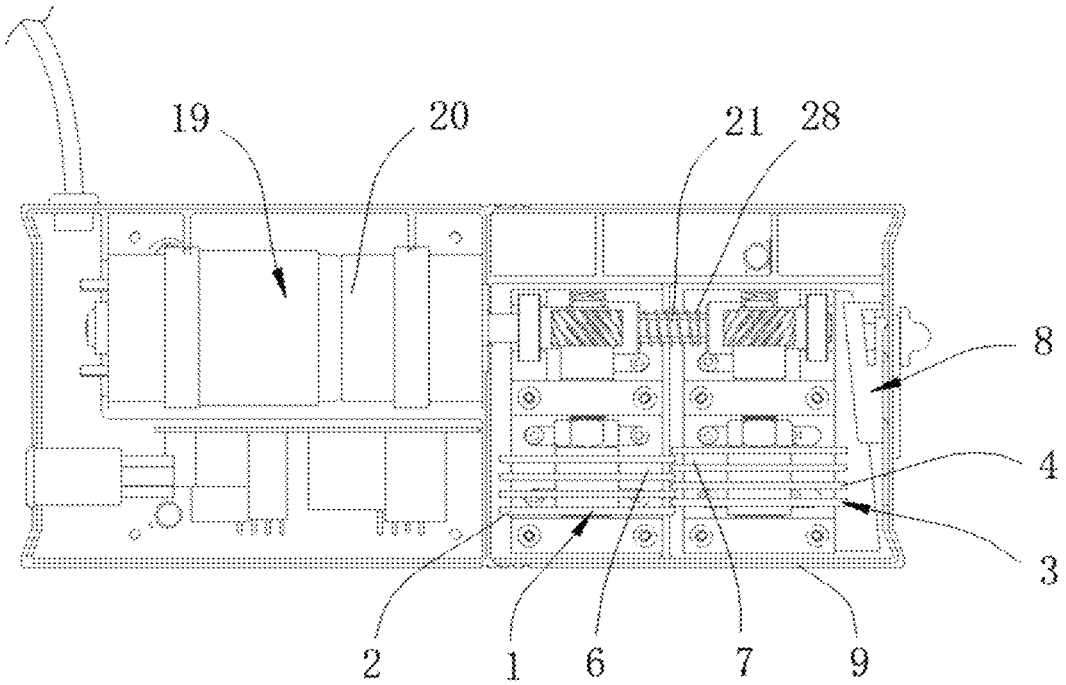
FIG. 1 is a schematic diagram of a structure of an electric knife sharpener according to an embodiment of the disclosure.
Figure 2:
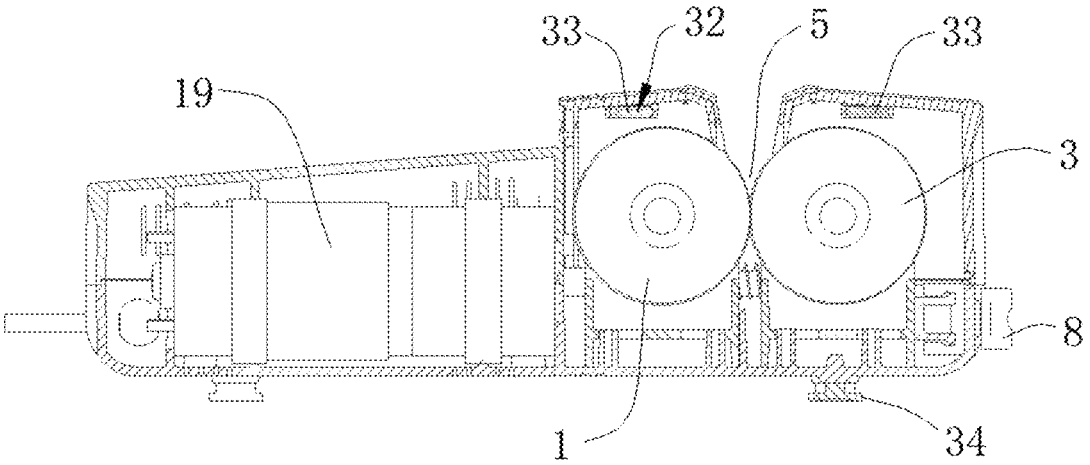
FIG. 2 is a schematic cross-sectional view of a structure of an electric knife sharpener according to an embodiment of the disclosure.

Referring to FIGS. 1 and 2, according to an embodiment of the disclosure, an electric knife sharpener includes: a first grinding structure 1, the first grinding structure 1 including a plurality of first grinding wheels 2 which are parallel to each other and configured to sharpen a knife, and adjacent first grinding wheels 2 being arranged spaced apart from each other; a second grinding structure 3, the second grinding structure 3 including a plurality of second grinding wheels 4 which are parallel to each other and configured to sharpen a knife, adjacent second grinding wheels being arranged spaced apart from each other at a spacing 7, a grinding space 5 for grinding a knife being formed between the first grinding structure 1 and the second grinding structure 3, a spacing 6 between the adjacent first grinding wheels being greater than a thickness of each of the second grinding wheels 4, a spacing 7 between the adjacent second grinding wheels being greater than a thickness of each of the first grinding wheels 2, and the first grinding wheels 2 and the second grinding wheels 4 being arranged in a staggered manner; and an adjustment structure 8, the adjustment structure 8 being capable of driving the second grinding structure 3 to move to adjust a depth by which each of the second grinding wheels 4 is inserted into a corresponding spacing 6 between the two adjacent first grinding wheels, so as to adjust a grinding included angle of the grinding space 5 to allow the grinding space 5 to be adapted to different knives.

In the electric knife sharpener according to the embodiment of the disclosure, the plurality of first grinding wheels 2 which are parallel to each other and configured to sharpen a knife and the plurality of second grinding wheels 4 which are parallel to each other and configured to sharpen a knife are provided, and the adjustment structure 8 is configured to adjust the depth by which each of the second grinding wheels 4 is inserted into the corresponding spacing 6 between the two adjacent first grinding wheels, so as to adjust the grinding included angle of the grinding space 5 to allow the grinding space 5 of the electric knife sharpener according to the embodiment of the disclosure to be adapted to different knives, such that the grinding of different knives is better facilitated, and the efficiency and quality of knife grinding are improved.

Figure 6:
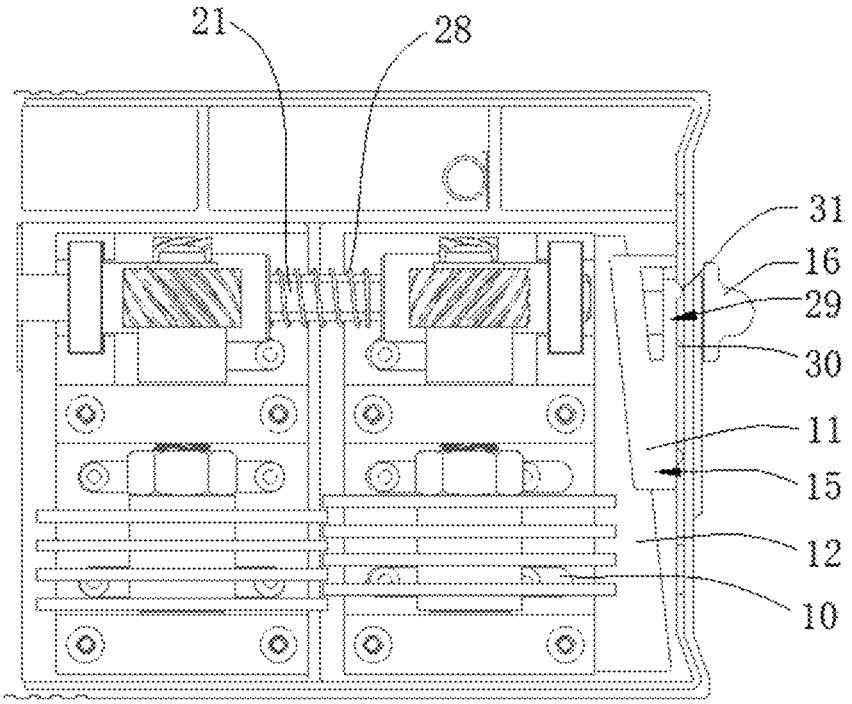
FIG. 6 is a schematic diagram of part of a structure of an electric knife sharpener according to an embodiment of the disclosure.

Referring to FIGS. 1 and 6, in an embodiment, the electric knife sharpener further includes a housing 9, the first grinding structure 1 being arranged on the housing 9, a sliding slot structure 10 being provided on the housing 9, the second grinding structure 3 being slidably connected to the sliding slot structure 10, and the second grinding structure 3 sliding in the sliding slot structure 10 to adjust the depth by which each of the second grinding wheels 4 is inserted into the corresponding spacing 6 between the two adjacent first grinding wheels. With the above structure, since the second grinding structure 3 slides along the sliding slot structure 10, the movement of the second grinding structure 3 is smoother, thereby making it more stable the process of adjusting the depth by which each of the second grinding wheels 4 is inserted into the corresponding spacing 6 between the two adjacent first grinding wheels. In other embodiments, another suitable structure is used instead of the sliding slot structure 10, as long as the second grinding structure 3 is displaced and the depth by which each of the second grinding wheels 4 is inserted into the corresponding spacing 6 between the two adjacent first grinding wheels are adjusted.

Figure 4:
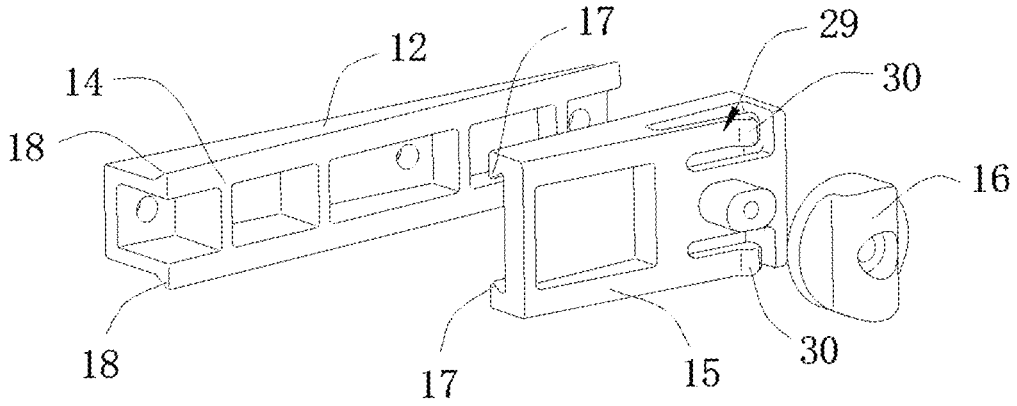
FIG. 4 is a schematic exploded view of a structure of an adjustment structure according to an embodiment of the disclosure.
Figure 8:
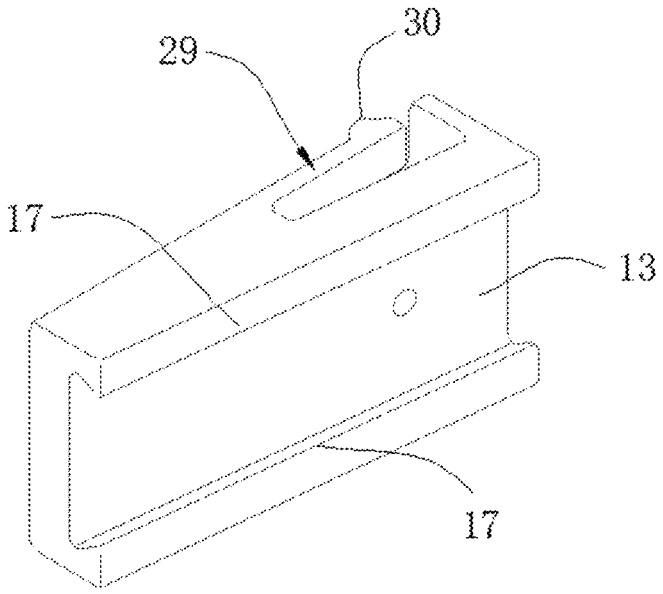
FIG. 8 is a schematic diagram of a structure of a sliding block according to an embodiment of the disclosure.

Referring to FIGS. 4, 6 and 8, in an embodiment, the adjustment structure 8 includes a first portion 11 and a second portion 12, the first portion 11 being slidably connected to the housing 9, the second portion 12 being connected to the second grinding structure 3, and the first portion 11 being slidably connected to the second portion 12. The first portion 11 is provided with a first inclined surface 13, the second portion 12 is provided with a second inclined surface 14, the first inclined surface 13 and the second inclined surface 14 have opposite directions of inclination, the first inclined surface 13 abuts against the second inclined surface 14, and by sliding the first portion 11, the first inclined surface 13 slides toward the direction of inclination of the second inclined surface 14, such that the second portion 12 is pushed to move toward the second grinding structure 3, and the second grinding structure 3 is pushed by the second portion 12 to move toward the first grinding structure 1. With the above structure, the structure is simple, the operation is stable, and the reliability is better. In other embodiments, the adjustment structure 8 is provided in another suitable structure instead of the structure described above.

In an embodiment, the first portion 11 includes a sliding block 15 and a shift member 16, the shift member 16 being fixedly connected to the sliding block 15, and the sliding block 15 being located inside the housing 9. The first inclined surface 13 is provided on the sliding block 15, the sliding block 15 is slidably connected to the second portion 12, the shift member 16 extends through the housing 9 to the outside of the housing 9, and a user manipulates the movement of the sliding block 15 by means of the shift member 16. In this way, when the user uses the electric knife sharpener of the disclosure, the operation is easier. In other embodiments, it is possible that the first portion 11 includes the sliding block 15, the sliding block 15 extends through the housing 9 to the outside of the housing 9, and the user moves the sliding block 15 by shifting the sliding block 15.

In an embodiment, a first engagement portion 17 is provided on the first portion 11, a second engagement portion 18 is provided on the second portion 12, and the first engagement portion 17 is in engagement connection with the second engagement portion 18. When the depth by which each of the second grinding wheels 4 is inserted into the corresponding spacing 6 between the two adjacent first grinding wheels is required to be reduced, the first portion 11 slides toward an original position, the second portion 12 is pulled by the first portion 11 to move toward the first portion 11, and the second grinding structure 3 is driven by the second portion 12 to move toward the first portion 11. With the above structure, the structure is simple, the operation is stable, and the reliability is better.

In an embodiment, each of the first grinding wheels 2 and each of the second grinding wheels 4 have opposite directions of rotation, and the direction of rotation of each of the first grinding wheels 2 at a side close to the second grinding structure 3 and the direction of rotation of each of the second grinding wheels 4 at a side close to the first grinding structure 1 are upward, such that a knife is ground in a direction from an edge of the knife to a back of the knife. In this way, an edge line generated by grinding of the electric knife sharpener of the disclosure will be perpendicular to an edge to create a vertical grinding line, such that the problem of single side-edge crimping during grinding is solved, burrs generated by grinding of the edge will be relatively reduced, the sharpness is increased, and the cutting effect after grinding is significantly improved. In other embodiments, it is possible that each of the first grinding wheels 2 and each of the second grinding wheels 4 have opposite directions of rotation, and the direction of rotation of each of the first grinding wheels 2 at a side close to the second grinding structure 3 and the direction of rotation of each of the second grinding wheels 4 at a side close to the first grinding structure 1 are downward.

Figure 3:
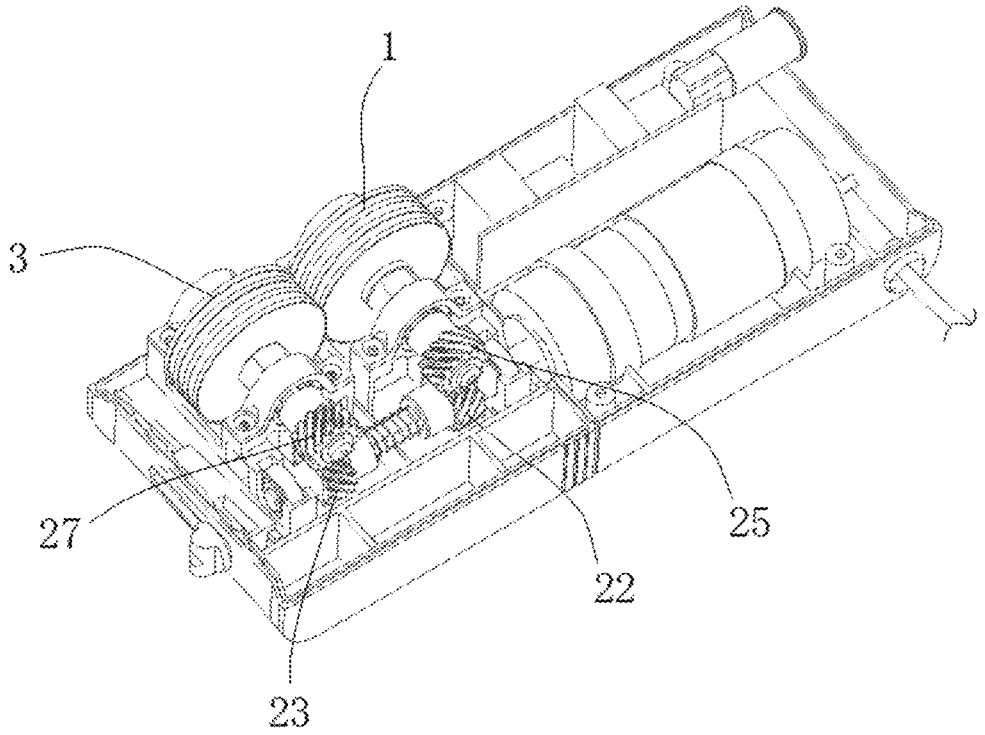
FIG. 3 is a schematic perspective view of part of a structure of an electric knife sharpener according to an embodiment of the disclosure.
Figure 5:
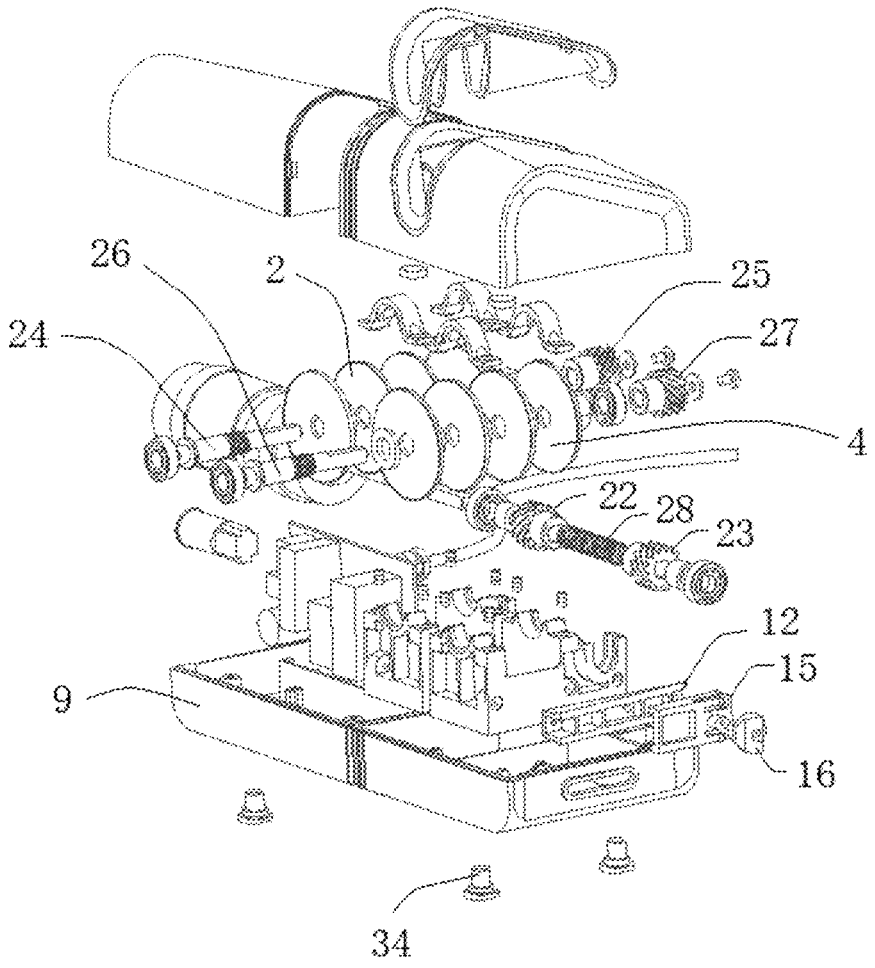
FIG. 5 is a schematic exploded view of a structure of an electric knife sharpener according to an embodiment of the disclosure.

Referring to FIGS. 1, 3 and 5, in an embodiment, the electric knife sharpener further includes: a driving device 19, the driving device 19 including an electric motor 20 and a spindle 21, the electric motor 20 driving the spindle 21 to rotate, a first gear 22 and a second gear 23 being sleeved on the spindle 21, and the first gear 22 and the second gear 23 both rotating synchronously with the spindle 21. The first grinding structure 1 includes a first rotating shaft 24, a third gear 25 is provided at an end of the first rotating shaft 24 close to the spindle 21, the first gear 22 is in orthogonal transmission connection with the third gear 25, each of the first grinding wheels 2 are sleeved on the first rotating shaft 24, and each of the first grinding wheels 2 rotates synchronously with the first rotating shaft 24. The second grinding structure 3 includes a second rotating shaft 26, a fourth gear 27 is provided at an end of the second rotating shaft 26 close to the spindle 21, the second gear 23 is in orthogonal transmission connection with the fourth gear 27, each of the second grinding wheels 4 are sleeved on the second rotating shaft 26, and each of the second grinding wheels 4 rotates synchronously with the second rotating shaft 26. The first rotating shaft 24 and the second rotating shaft 26 have opposite directions of rotation. With the above structure, the structure is simple, the operation is stable, and the reliability is better. In other embodiments, the driving device 19 is provided in another suitable structure instead of the structure described above.

Referring to FIG. 6, in an embodiment, a spring 28 is sleeved on the spindle 21, the spring 28 is located between the first gear 22 and the second gear 23, the spring 28 has one end abutting against the first gear 22, and the spring 28 has the other end abutting against the second gear 23. In this way, since the first grinding structure 1 and the second grinding structure 3 will vibrate in the process of grinding a knife with the electric knife sharpener of the disclosure, the spring 28 is provided to buffer the vibration of the first grinding structure 1 and the second grinding structure 3, thereby reducing the impact on the driving device 19, and allowing the electric knife sharpener of the disclosure, when grinding a knife, to be more stable in the process of grinding a knife and to have a better durability. In other embodiments, no spring 28 is sleeved on the spindle 21. In other embodiments, the spring 28 is provided in another suitable structure.

Referring to FIGS. 4 and 6, in an embodiment, an elastic sheet structure 29 is provided on the first portion 11, and a bump 30 is provided on the elastic sheet structure 29. A plurality of recesses 31 are provided on an inner wall of the housing 9. By moving the first portion 11, the bump 30 falls into any one of the recesses 31, each of the recesses 31 corresponding to one adjustment position. In this way, the depth by which each of the second grinding wheels 4 is inserted into the corresponding spacing 6 between the two adjacent first grinding wheels is more easily controlled, and in the process of grinding a knife, the user adjusts the first portion 11 to an appropriate adjustment position depending on the size of the knife, achieving a simple and fast operation. In other embodiments, no elastic sheet structure 29 is provided on the first portion 11, and no recess 31 is provided on the inner wall of the housing 9.

In an embodiment, the electric knife sharpener further includes an iron filings removal structure 32, the iron filings removal structure 32 includes a magnet 33, and the magnet 33 attracts iron filings generated when the first grinding structure 1 and the second grinding structure 3 grind a knife. In this way, the iron filings generated when the first grinding structure 1 and the second grinding structure 3 grind the knife are prevented from being too scattered, and after the magnet attracts the iron filings generated when the first grinding structure 1 and the second grinding structure 3 grind the knife, the user centrally cleans up the iron filings, achieving a high cleanup efficiency and easy operation. In other embodiments, no iron filings removal structure 32 is included in the electric knife sharpener.

Figure 7:
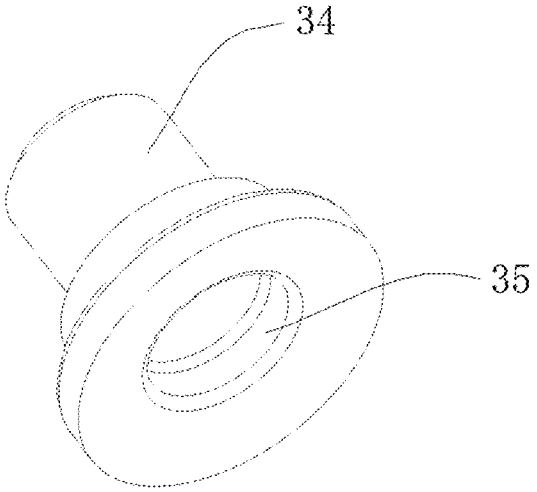
FIG. 7 is a schematic perspective view of a structure of a footpad according to an embodiment of the disclosure.

Referring to FIGS. 1 and 7, in an embodiment, a footpad 34 is provided on a bottom of the housing 9, a bottom of the footpad 34 is in the form of a suction cup structure 35, and the suction cup structure 35 sucks the housing 9 to an external placement surface. In this way, under the suction of the suction cup structure 35, the electric knife sharpener according to the embodiment of the disclosure is prevented from shifting during operation, such that the electric knife sharpener according to the embodiment of the disclosure is used more stably by the user, and the efficiency and quality of knife grinding are improved. In other embodiments, no suction cup structure 35 is provided on the bottom of the footpad 34.

Those skilled in the art freely combine and use the above additional technical features provided that no conflict occurs.

The foregoing embodiments are only embodiments of the disclosure and cannot be used to limit the scope of protection of the disclosure. All non-essential modifications and substitutions made by those skilled in the art on the basis of the disclosure shall fall within the scope of protection of the disclosure.

What is claimed:

1. A knife sharpener, comprising:

a first grinding structure, the first grinding structure comprises a plurality of first grinding wheels, each of the plurality of first grinding wheels being placed parallel to each other and configured to sharpen a knife, each of the plurality of first grinding wheels being arranged to spaced apart from each other;

a second grinding structure, the second grinding structure comprises a plurality of second grinding wheels, each of the plurality of second grinding wheels being parallel to each other and configured to sharpen the knife, each of the plurality of second grinding wheels being arranged to spaced apart from each other;

a grinding space for grinding a knife being formed between the first grinding structure and the second grinding structure;

a spacing between each adjacent pair of the plurality of first grinding wheels being greater than a thickness of at least one of the plurality of second grinding wheels;

a spacing between each adjacent pair of the plurality of second grinding wheels being greater than a thickness of at least one of the plurality of first grinding wheels, wherein the plurality of first grinding wheels and the plurality of second grinding wheels are arranged in a staggered manner;

an adjustment structure, the adjustment structure configured to drive the second grinding structure to move to adjust a depth, whereby each of the plurality of second grinding wheels is inserted into the corresponding first spacing, to adjust a grinding included angle of the grinding space to allow the grinding space to be adapted to different knives; and a housing, the first grinding structure being arranged on the housing, the housing being provided with a sliding slot structure, the second grinding structure being slidably connected to the sliding slot structure, the second grinding structure slides in the sliding slot structure to adjust the depth to insert each of the plurality of second grinding wheels into the corresponding first spacing.

2. The knife sharpener according to claim 1, wherein the adjustment structure comprises a first portion and a second portion, the first portion being slidably connected to the housing, the second portion being connected to the second grinding structure, and the first portion being slidably connected to the second portion;

wherein the first portion is provided with a first inclined surface, the second portion is provided with a second inclined surface, the first inclined surface and the second inclined surface have opposite directions of inclination, the first inclined surface abuts against the second inclined surface, and by sliding the first portion, the first inclined surface slides toward the direction of inclination of the second inclined surface, such that the second portion is pushed to move toward the second grinding structure, and the second grinding structure is pushed by the second portion to move toward the first grinding structure.

3. The knife sharpener according to claim 2, wherein a first engagement portion is provided on the first portion, a second engagement portion is provided on the second portion, the first engagement portion is in engagement connection with the second engagement portion, and when the depth by which each of the second grinding wheels is inserted into the corresponding spacing between the two adjacent first grinding wheels is required to be reduced, the first portion slides toward an original position, the second portion is capable of being pulled by the first portion to move toward the first portion, and the second grinding structure is driven by the second portion to move toward the first portion.

4. The knife sharpener according to claim 1, wherein each of the first grinding wheels and each of the second grinding wheels have opposite directions of rotation, and the direction of rotation of each of the first grinding wheels at a side close to the second grinding structure and the direction of rotation of each of the second grinding wheels at a side close to the first grinding structure are upward, such that a knife is ground in a direction from an edge of the knife to a back of the knife.

5. The knife sharpener according to claim 4, further comprising:

a driving device, the driving device comprising an electric motor and a spindle, the electric motor driving the spindle to rotate, and a first gear and a second gear being sleeved on the spindle, and both rotating synchronously with the spindle;

the first grinding structure comprising a first rotating shaft, a third gear being provided at an end of the first rotating shaft close to the spindle, the first gear being in orthogonal transmission connection with the third gear, and each of the first grinding wheels being sleeved on the first rotating shaft, and rotating synchronously with the first rotating shaft;

the second grinding structure comprising a second rotating shaft, a fourth gear being provided at an end of the second rotating shaft close to the spindle, the second gear being in orthogonal transmission connection with the fourth gear, and each of the second grinding wheels being sleeved on the second rotating shaft, and rotating synchronously with the second rotating shaft; and the first rotating shaft and the second rotating shaft having opposite directions of rotation.

6. The knife sharpener according to claim 5, wherein a spring is sleeved on the spindle and located between the first gear and the second gear, the spring having one end abutting against the first gear and the other end abutting against the second gear.

7. The knife sharpener according to claim 2, wherein an elastic sheet structure is provided on the first portion, a bump is provided on the elastic sheet structure, a plurality of recesses are provided on an inner wall of the housing, and by moving the first portion, the bump is capable of falling into any one of the recesses, each of the recesses corresponding to one adjustment position.

8. The knife sharpener according to claim 1, further comprising an iron filings removal structure, the iron filings removal structure comprising a magnet, and the magnet being capable of attracting iron filings generated when the first grinding structure and the second grinding structure grind a knife.

9. The knife sharpener according to claim 1, wherein a footpad is provided on a bottom of the housing, a bottom of the footpad being in the form of a suction cup structure, and the suction cup structure being capable of sucking the housing to an external placement surface.

* * * * *